US005165741A

United States Patent [19]

Everett

[11] Patent Number: 5,165,741

[45] Date of Patent: Nov. 24, 1992

[54] SECURITY DOOR BAR

[76] Inventor: James D. Everett, 1131 Bull Run, Richardson, Tex. 75080-1404

[21] Appl. No.: 881,496

[22] Filed: May 11, 1992

[51] Int. Cl.[5] ..... E05C 17/12

[52] U.S. Cl. ..... 292/259 R; 292/DIG. 60; 292/257

[58] Field of Search ..... 292/259 R, DIG. 60, 292/258, 260, 257

[56] References Cited

U.S. PATENT DOCUMENTS 3,761,135 9/1973 Mundinger et al. ..... 292/259 X
4,067,598 1/1978 Mansour ..... 292/259 R
4,079,972 3/1978 Hagopian ..... 292/259 R
4,082,332 4/1978 Palmer ..... 292/259 R
4,667,992 5/1987 Roden, Jr. ..... 292/259 R

*Primary Examiner*—Richard E. Moore

[57] ABSTRACT

A security door bar adapted to prevent the opening of a door by intruders and comprising a resilient metal bar which carries a polygon shaped block through which pressure is applied to the door. The metal bar being adjustable to the width of the door and the polygon shaped block being rotatable on the bar to adjust for door thickness and amount of pressure to be applied to the door. The metal bar is adapted to the door by use of a metal screw hook which is screwed into a wall stud on the knob side of the door and pressure is applied to the door from the metal bar through the polygon block and a pressure distribution sheet attached to the door.

18 Claims, 9 Drawing Sheets

SECURITY DOOR BAR

BACKGROUND OF THE INVENTION

This invention relates to mechanical security devices for doors to prevent the forcible opening by intruders. In particular this invention relates to security door bars.

DESCRIPTION OF PRIOR ART

Almost every day television shows the public video scenes of policemen kicking open the doors of suspected criminals. The public and the criminals are becoming aware of how easy it is to kick open the doors to a home which were thought safe. The home or apartment dweller is becoming concerned about this safety issue as evidenced by the number of new kick proofing devices on the market. In the past it has been well known to employ a bar across a door to prevent forcible entry. For example the patent issued to Palmer, U.S. Pat. No. 4,082,332 (1978) discloses a tubular metal cross bar which is adapted to extend between brackets on either side of the door. The patent issued to Mansour, U.S. Pat. No. 4,067,598 (1978) discloses a door bar which employs telescoping metal tubes which are fixed together and permanently attached at one end, to be swung across the door opening and clipped into a locking bracket at the hinge side of the door.

Prior mechanical security devices of the above type suffer from a number of deficiencies:

(a) They do not apply static pressure against the door in their basic operative position. They will likely fail from an intruder kicking the door because of inertia generated by the kick and the distance the door is allowed to move before encountering counter pressure from the cross bar. As a minimum, the door or door frame will be destroyed as the bolt from the knob assembly impacts the strike plate before the cross bar mechanism is engaged sufficiently to halt the movement of the door.

(b) Prior designs did not provide an efficient method of transferring impact energy from the door being protected to their device. These devices allowed door surfaces to absorb impacts over a 2 to 3 square inch area or less. Thin doors or hollow core doors are likely to be damaged or destroyed when impacted under these conditions.

(c) The use of visible brackets, spacers, screws, and bolts for mounting and adjusting the mechanism to the door is excessive in prior art. These hardware items are obtrusive to both women and men in their homes.

(d) Mechanisms in present use are not quickly or easily adjustable when moved from door to door either in length or in adaptability to door thickness.

(e) The use of latching brackets and slide through brackets make prior mechanisms of this type difficult to disengage by children in case of fire or other emergency.

OBJECTS AND ADVANTAGES

It is accordingly an object of the present invention to provide a security door bar which will:

(a) Transfer energy from a kicking impact directly to a transverse resilient bar which is continuously applying pressure to the door and against potential kicking impacts. As the kicking impact causes the door to move against the bar the bar will deflect a greater distance and generate greater back force against the kicking impact. The amount of movement allowed resulting from a kick will be proportional to the static pressure applied by the device. This pressure being adjustable by the operator.

(b) Be portable to other doors and quickly adjustable to different door widths and thicknesses.

(c) Be easy to install in a matter of minutes.

(d) Be unobtrusive when not in use, both by being removable from the vicinity of the door and by providing mounting hardware around the door which is simple and unobtrusive.

(e) Provide a mechanical security device which is economical to manufacture.

(f) Be simple to operate.

(g) Not scratch or otherwise mar the door or door frame while being engaged or disengaged.

(h) Be easy to disengage and remove in case of an emergency.

DRAWING FIGURES Some of the objects of the invention have been stated, other objects will appear in the description proceeds, when taken in connection with the accompanying drawings, in which.

Figure 1:
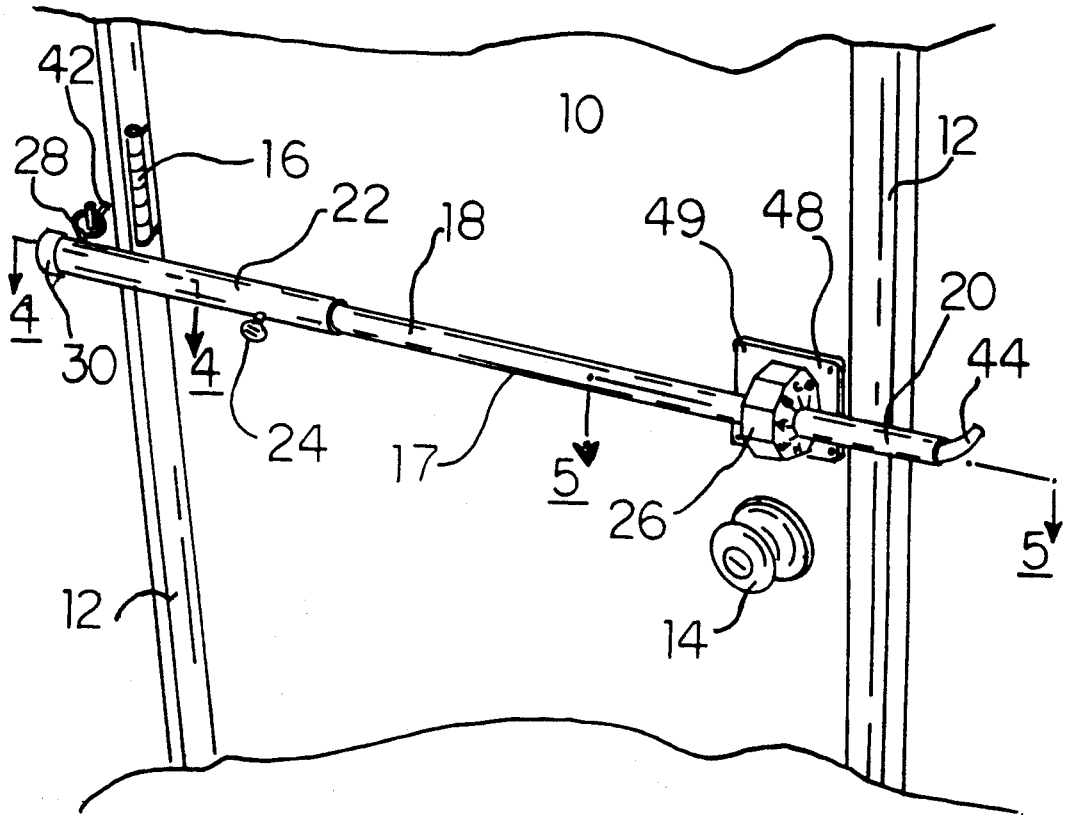
FIG. 1 is a fragmentary perspective view illustrating a mechanical security device embodying the features of the present invention and showing the same in its operative position across a door opening.
Figure 5:
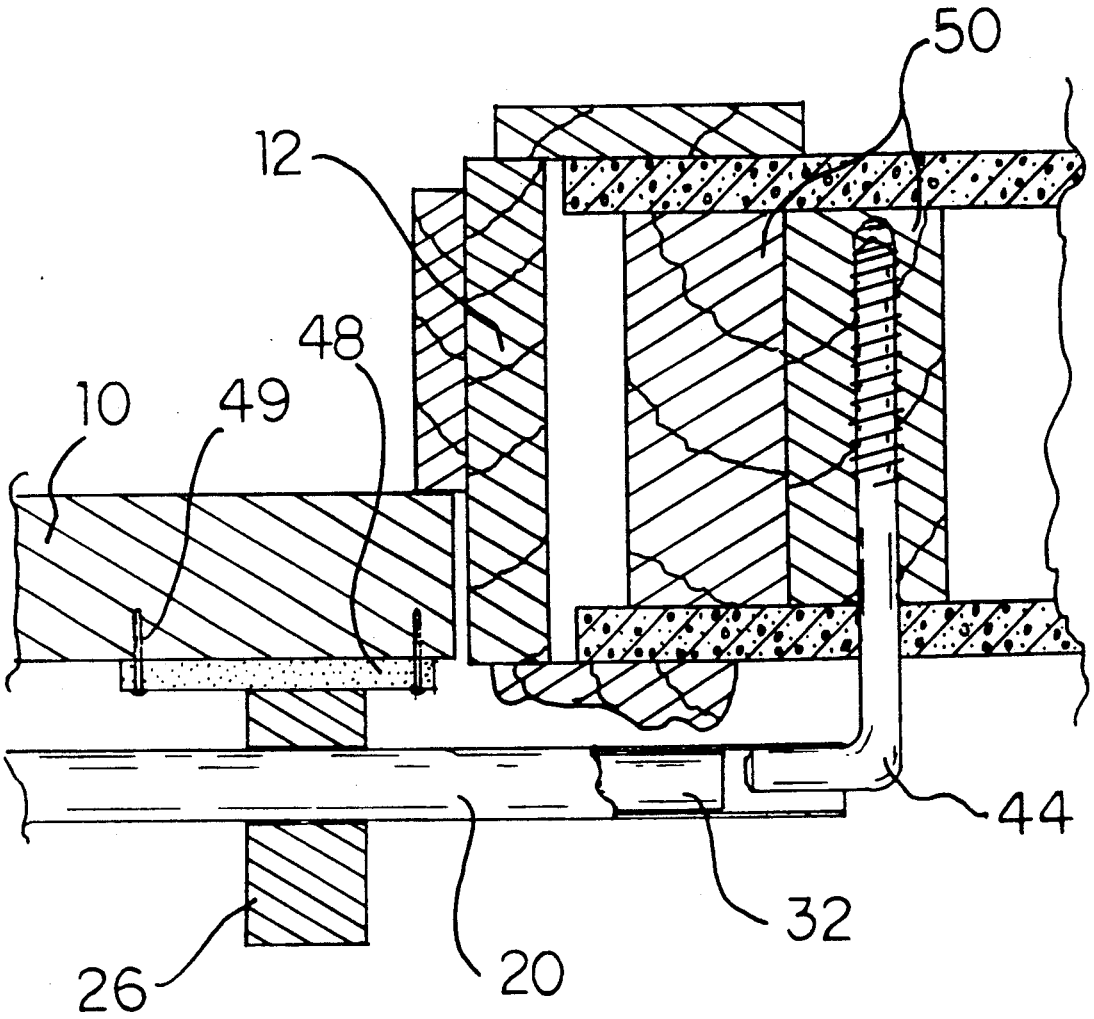

FIG. 5 is a sectional top view taken substantially along line 5—5 of FIG. 1 of the knob side screw hook operationally engaging the tubular element 20 on the latching member 18.

Figure 6:
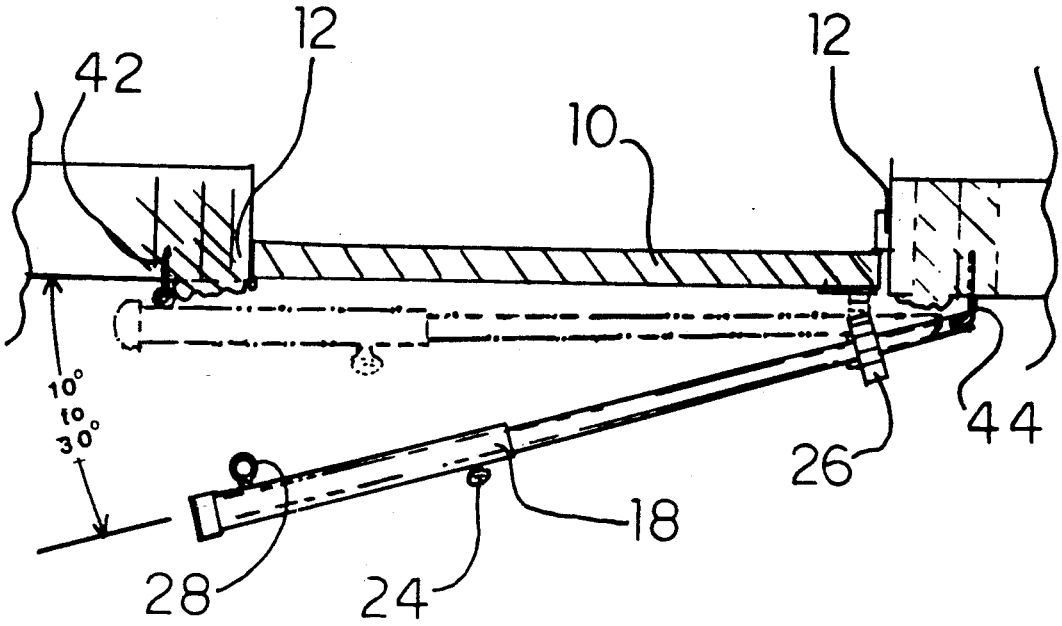

FIG. 6 shows a top view operational perspective of latching member 18.

Figure 7:
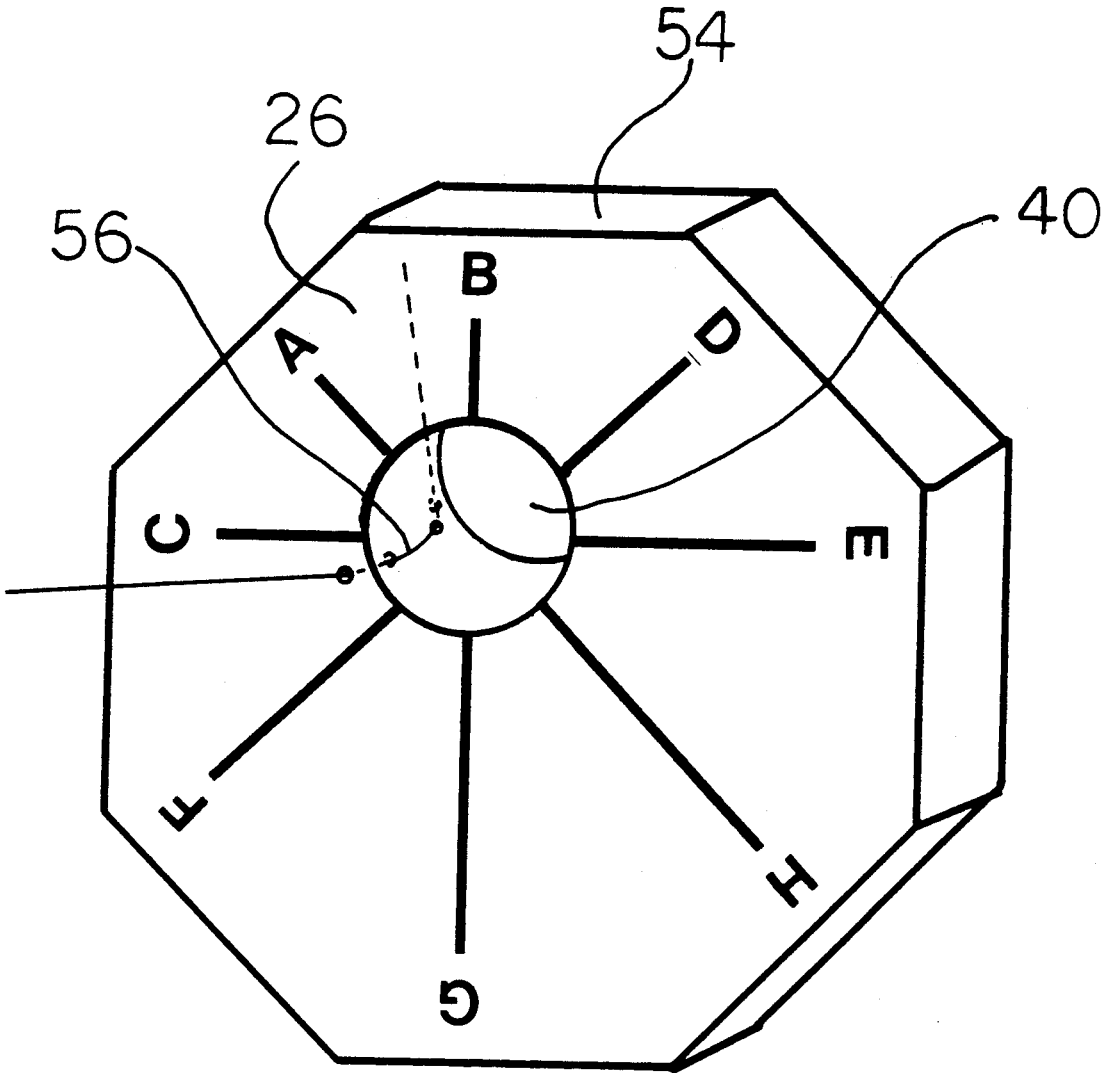

FIG. 7 is a perspective view of an alternative embodiment of a piano wire tensioning device.

Figure 8:
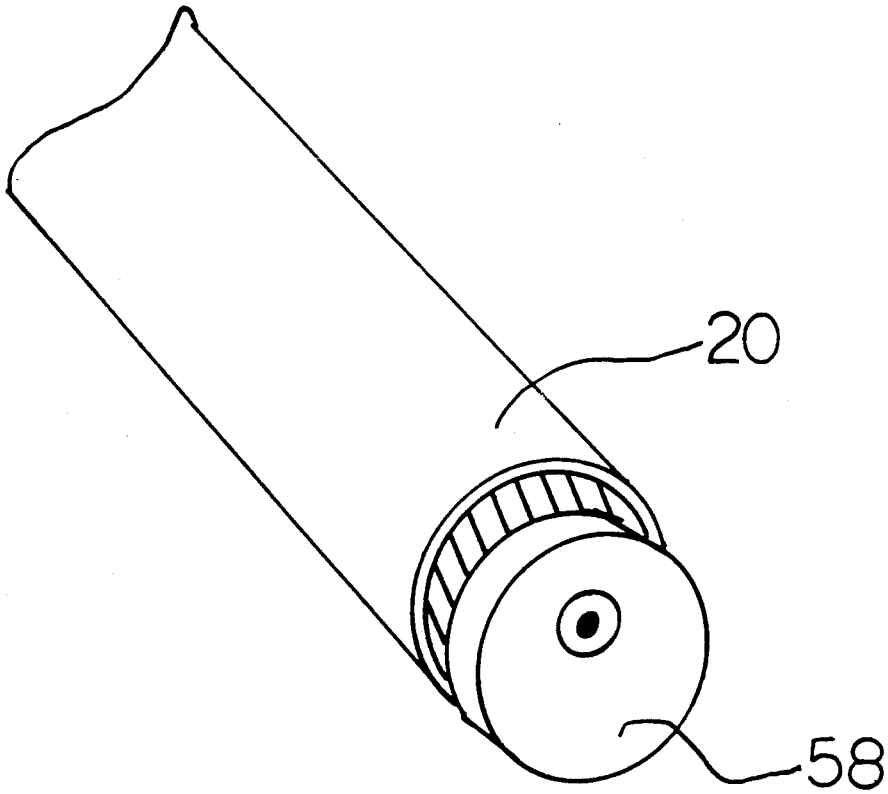

FIG. 8 is a perspective view of an alterative embodiment of a "tent pole" type cam device for fixing the tubular elements together.

Figure 9:
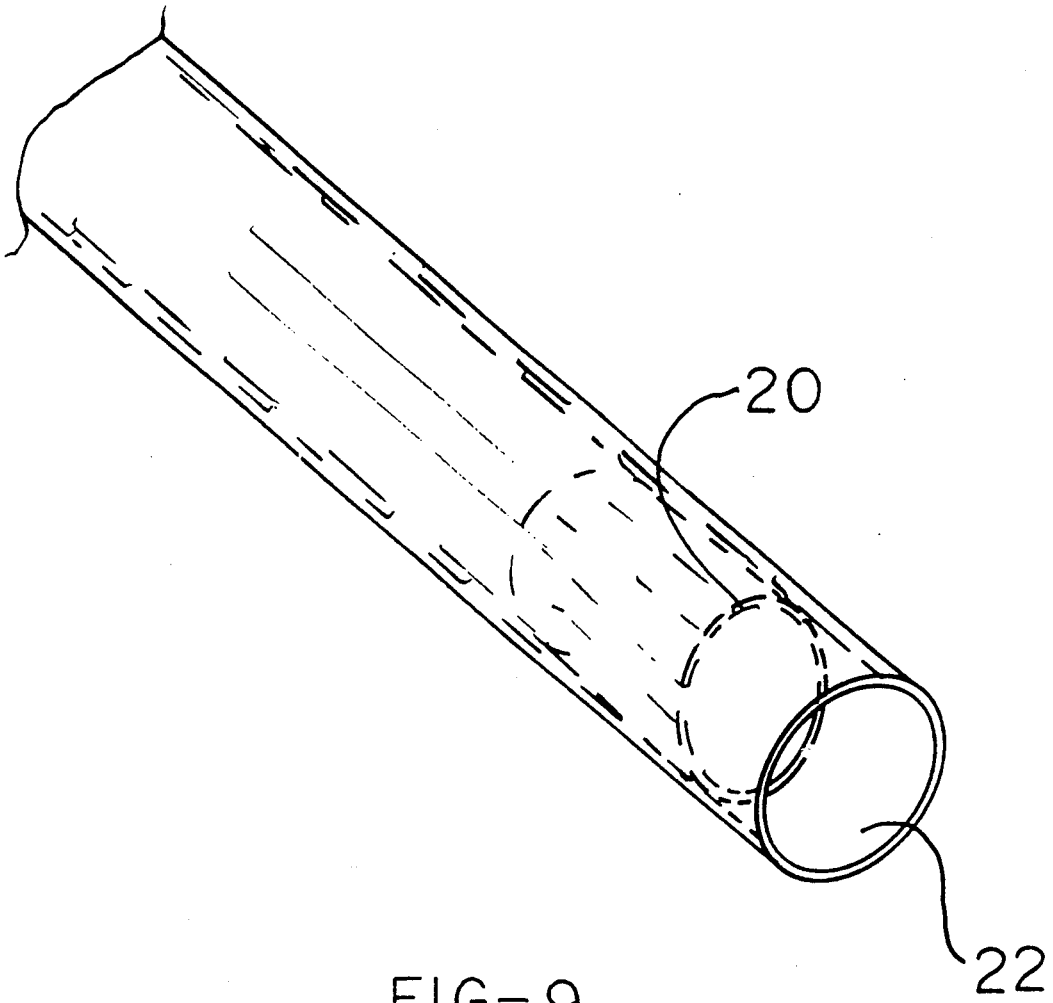

FIG. 9 is a perspective view of an alternative embodiment showing elements 20 and 22 as concentric ellipses.

REFERENCE NUMBERS IN DRAWINGS

| | |
|---|---|
| 10 | door |
| 12 | door frame |
| 14 | door knob |
| 16 | door hinges |
| 17 | door bar assembly (20–49) |
| 18 | latching member (20–32) |
| 20 | tubular element |
| 22 | tubular element |
| 24 | thumb screw |
| 26 | octagon block |
| 28 | eye screw |
| 30 | plastic end cap |
| 32 | steel rod |
| 40 | hole in octagon |
| 42 | screw hook (hinge side) |
| 44 | screw hook (knob side) |
| 46 | piano wire staple |
| 48 | plastic plate |
| 49 | small nails |
| 50 | wall stud (knob side) |
| 52 | wall stud (hinge side) |
| 54 | octagon face |
| 56 | piano wire tension device |

-continued

| | |
|---|---|
| 58 | tent pole type cam latch |

DESCRIPTION—FIGS. 1—5.

Figure 2:
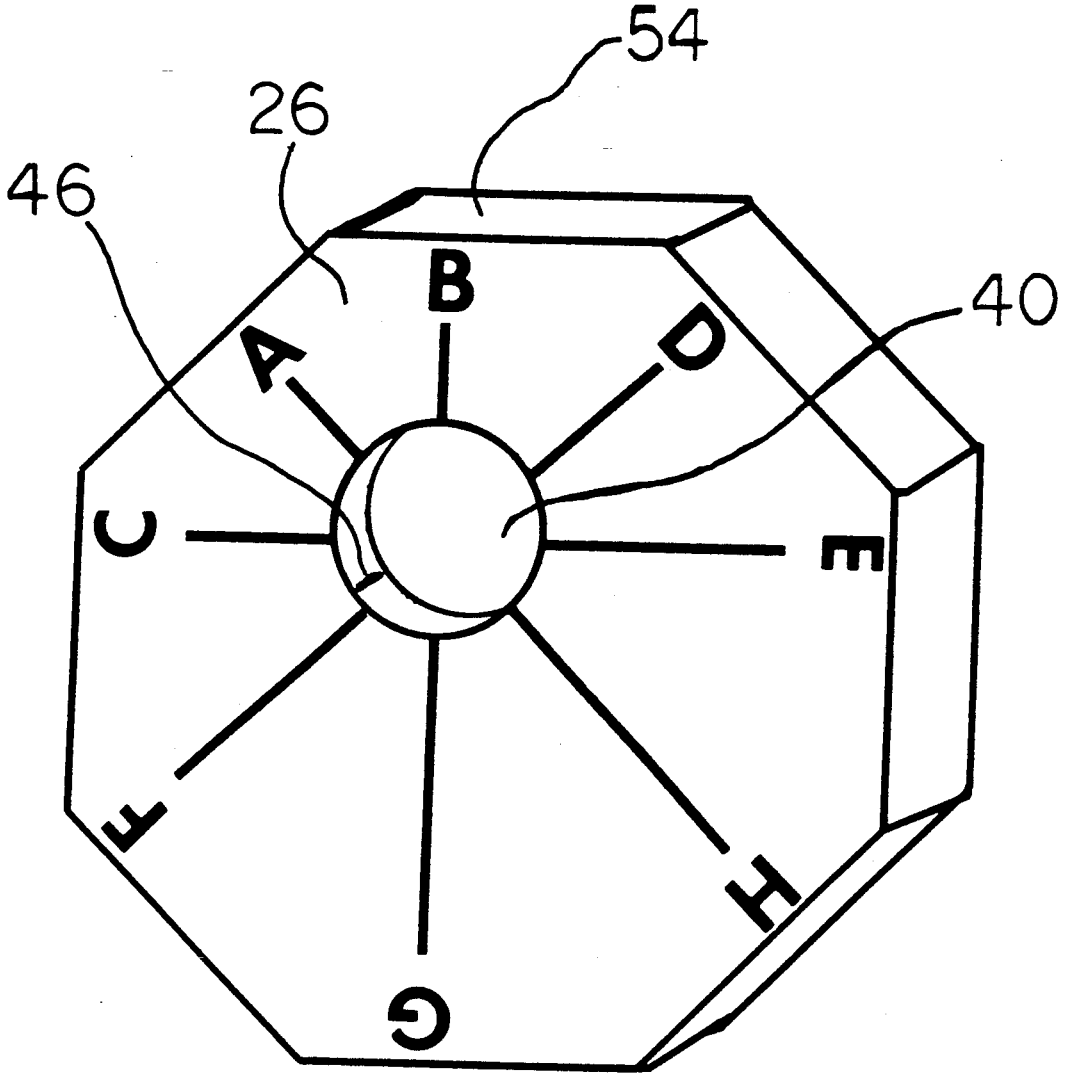
FIG. 2 is a perspective view of polygon block 26 an octagon.
Figure 3:
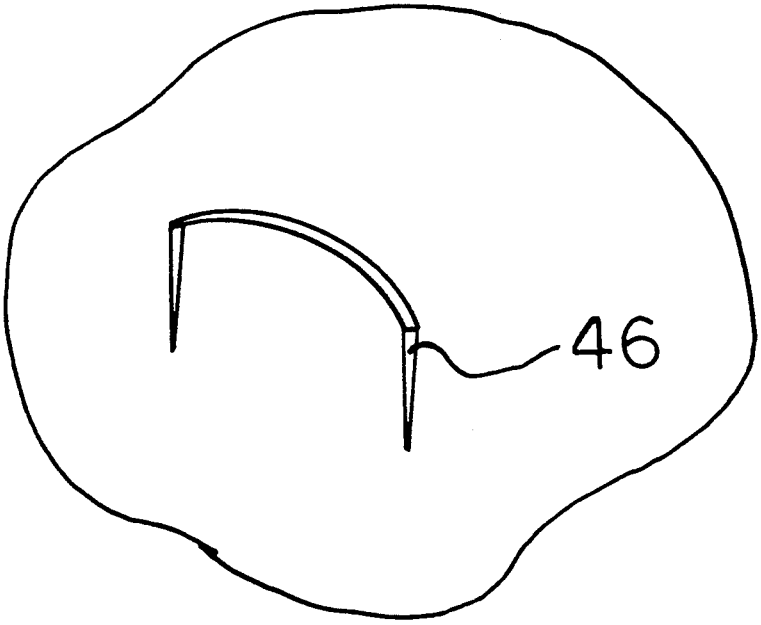
FIG. 3 is a perspective view of piano wire staple 46.

FIG. 1 illustrates a conventional door 10, frame 12, door knob 14 and hinges 16 with an inventive door bar attached. The security door bar assembly 17, or door bar, is designed to secure any swinging door 10 which opens inward and is less than, as an example, 45 inches in width. The device 17 is comprised of a latching member 18, including a pair of tubular metal elements 20 and 22. First tubular element 20 being telescopically received into second tubular element 22 and held in any desired position with respect to second element 22 by a securing means, such as thumb screw 24 which is screwed through a threaded hole in element 22. This thumb-screw is used to temporarily fix the combined length of elements 20 and 22. It is only one of many securing means and methods which may be employed for this purpose, such as an oval-shaped tube twist lock (FIG. 9) or offset cam twist lock used on modern small tent poles (FIG. 8). While the type of securing is not of major significance in method, the thumb screw is advantageous for its convenience, ease of operation and low cost to manufacture. A polygon block 26, in this embodiment (FIG. 2) is received over first tubular element 20 by means of hole 40 which is slightly larger in diameter than element 20. FIG. 2 illustrates a preferred octagon shaped block 26 with hole 40 positioned such that the distances from the center of the hole to each face 54 of the octagon, marked 'A' through 'H', are different, 'A' being the shortest distance and 'H' being the longest distance. When not in use octagon block 26 is prevented from freely sliding on or rotating around first tubular element 20 by an internal tension element 46 such as a piano wire staple 46, as shown in FIG. 3, which is secured as by pressing the staple into the block inside hole 40 and provides a friction fit between the octagon and tubular element 20. An alternative tensioning device is shown in FIG. 7, whereby a length of piano wire 58 is inserted through two holes into the opening of hole 40. This friction fit allows the octagon to be slid along or rotated around element 20 by hand as desired. The octagon block 26 is made from wood particle board in the preferred embodiment but may be made from plastic or other substance which will withstand pressure of more than 700 lb per square inch. Strength against bending is increased by inserting a 1 foot long steel rod 32 into tubular element 20 to lie underneath octagon block 26 and 1 inch beyond the end of element 20 as shown in FIG. 5. The steel rod is round and slightly smaller in diameter than the inside diameter of element 20 and is secured in place as by gluing it in place using a flexible adhesive.

Figure 4:
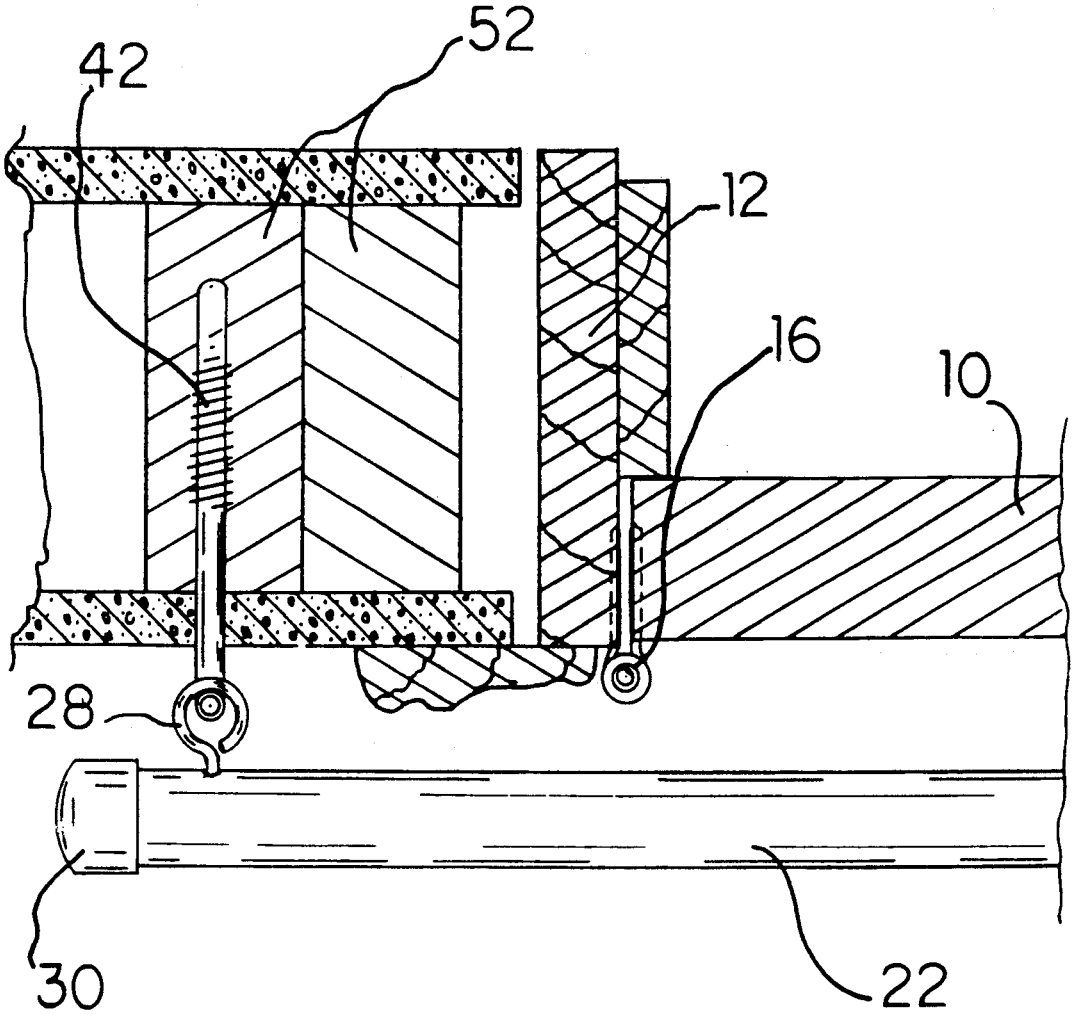
FIG. 4 is a sectional top view taken substantially along line 4—4 of FIG. 1 of the hinge side screw hook operationally engaging the eye screw in the latching member 18.

The security door bar 7 is installed such that octagon block 26 acts as a fulcrum point on the latching member 18 and applies pressure to the door 10 to prevent opening. Installation of the device is advantageously accomplished by installing small screw hook 42, as in FIG. 4, into wall stud 52 on the hinge side of the door frame and another larger screw hook 44, as in FIG. 5, into wall stud 50 on the knob side of the door frame. The wall studs are used to mount the door bar 17 because it has been found that the door frame 12 is not structurally sound, particularly on the door knob side of the frame. However the door frame may be used in those cases in which it is structurally as strong as the wall studs. Holes slightly smaller in diameter than screw hooks 42 and 44 are drilled into the studs on a horizontal line approximately 4 to 6 inches above door knob 14. This facilitates installation of the two screw hooks. The plastic plate 48 is attached to the door centered on the above horizontal line between the screw hooks and about ¼ inch from the doorknob edge of the door. Plate 48 is 3 or more inches square and ¼ inch or more thick, it is generally transparent and is attached to the door with 4 small fasteners 49, such as nails or screws. The telescoping tubular elements 20 and 22 carrying octagon block 26 are assembled with plastic end cap 30 and eye screw 28 on the door hinge end of member 18 as in FIG. 4 to form the complete latching member 18.

From the description above, a number of advantages of my door bar become evident:

(a) In an operative position the security door bar can apply great pressure against the door. A kicking impact will cause little movement in the door with respect to its frame.

(b) The latching member is quickly transportable to another door and adjustable within seconds to the other door.

(c) The security door bar is installed with electric drill, hammer, and pliers in a matter of minutes.

(d) Disengagement in an emergency is accomplished by simply pressing up on the hinge end of the latching mechanism. A child of three can remove the door bar in less than three seconds.

(e) When the latching mechanism is removed from the vicinity of the door only two hooks and a transparent plastic plate are visible. This is an improvement over prior designs from an appearance point of view.

(f) The plastic plate protects the door from scratching in normal engaging and disengaging.

(g) The door bar is economical to manufacture, using readily available raw materials and hardware.

OPERATION FIG. 6

The latching member 18 is engaged to the door by inserting the octagon carrying end of element 18 over screw hook 44 at approximately a 20 degree angle to the door. (FIG. 6). The octagon block 26 is slid into position along tube 20 such that it overlies plastic plate 48. Block 26 is then rotated on latching member 18 such that one of the block faces 54 (A through H) will engage plate 48 squarely as the hinge end of latching member 18 is pressed toward the door 10. This process of rotating the block and moving the latching member toward the door is repeated with different faces of the block until one face is chosen such that the latching member will flex without permanent bending through approximately the last 5 degrees of movement toward the door. When the optimum face of the octagon is chosen to lie against plastic plate 48, thumb screw 24 is loosened to allow tubular members 20 and 22 to slide relative to each other to a position such that eye screw 28 will exactly engage screw hook 42 as the latching member is pressed into locking position. Thumb screw 24 is then tightened to retain the appropriate length and the operator flexes the latching member into position and engages eye screw 28 over screw hook 42 thereby latching the member into operating position. The leverage applied to door 10 by the security door bar 17 provides a mechanical advantage of up to 50 to 1 and pressures of over 500 lbs. are rather easily applied by the operator.

SUMMARY, RAMIFICATIONS, AND SCOPE

Accordingly, the reader will see that the security door bar is easily installed and will protect a door from kicking or banging intruders. It is easily removed in case of emergency, even by a child. Furthermore, the door bar has the additional advantages that:

* it is relatively unobtrusive when not in use;
* it will not scratch or otherwise mar the door in normal use;
* it is portable to other doors and quickly adjustable to those doors;
* it retains its adjustment for reuse on the same door;
* it is simple to operate; and
* it is economical to manufacture.

Although the above description contains many specifications, these should not be considered as limiting the scope of the invention, but as merely providing illustrations of some of the preferred embodiments of the invention. For example, the octagon can have other shapes, such as square, pentagon, hexagon, etc,; the thumb screw can be eliminated by the use of two elliptical concentric tubes in place of elements 20 and 22, or by other mechanisms presently used on tent poles or the like to lock the concentric tubes together; and other modifications and variations may be made without departing from the invention.

Thus, the scope of the invention should be determined by the appended claims and their legal equivalents, rather than by the examples given.

What is claimed is:

1. An adjustable security door bar assembly for use in securing an inwardly opening door, which door is hingably mounted in a wall at one side of its width and openable at the other side, said security door bar comprising:

a) a latching member extendable in an elongated direction across said door from beyond said hinged side to beyond said openable side of the door;

b) means attached to said wall adjacent both sides of the door for detachably securing said latching member to said wall in a position across and substantially parallel and spaced apart a short distance from an inward surface of the door; and c) a polygon-shaped tension block defining flat faces about a periphery of the polygon shape and further defining a cylindrical-shaped hole therethrough along an axis, which axis of said cylindrical hole is parallel to each of said faces and oriented in said block so that the cylindrical hole is offset a different perpendicular distance from at least two of said flat faces and which cylindrical hole is sized for slip fit rotational mounting on the latching member and selectably positioned for engagement of one of the flat faces against said inward door surface at said openable side of the door, such that one of said different distances from the cylindrical hole to one of the flat faces is selected corresponding to said spaced apart short distance between the door and the latching member so that tension is exerted upon the door when the latching member is detachably secured by said securing means across the door.

2. An adjustable security door bar assembly as in claim 1 wherein said polygon shaped block comprises a rigid block.

3. An adjustable security door bar assembly as in claim 2 wherein said polygon shaped rigid block comprises a sufficiently offset cylindrical hole so that said distance between said hole and said face can be selected in increments of between about 1/10 and ½ of an inch.

4. An adjustable security door bar assembly as in claim 2 wherein said polygon shaped rigid block comprises a sufficient number of sides so that a maximum difference in distances from said hole to any two of said faces is between about ½ to about 5 inches.

5. An adjustable security door bar assembly as in claim 1 wherein said polygon shaped block comprises an octagon shape.

6. An adjustable security door bar assembly as in claim 1 wherein said polygon shaped block and said offset cylindrical hole is constructed to cooperate with said latching member so that said face of said polygon block contacts the door when said latching member is at about 10 to about 30 degrees with respect to its secured parallel position.

7. An adjustable security door bar assembly as in claim 1 wherein said hole is sufficiently offset so that perpendicular lines are extendable on a cross-sectional plane from each face to the center of said hole which perpendicular lines intersect each face at a point greater than 1/10 inch from an intersection of each face with an adjacent face of said polygon shape.

8. An adjustable security door bar assembly as in claim 1 further comprising a rigid flat scar-resistant plate fastened to said door against which said polygon shaped block faces so that tension is placed on the door through said plate without scarring the door.

9. An adjustable security door bar assembly as in claim 1 wherein said latching member comprises:

a) first and second tube members slidably engaging each other for adjustably defining a length greater than the width of said door; and b) means for reversibly securing said tube members to each other at an adjusted length greater than the width of the door.

10. An adjustable security door bar assembly as in claim 9 wherein:

a) said tube member comprises an interior and an exterior tube member telescopically slidable, one inside of the other; and b) said means for reversibly securing said tube members at an adjusted length comprises a threaded hole and thumb screw fastened through said exterior tube member for reversibly locking against said interior tube member to reversibly secure it in place.

11. An adjustable security bar assembly as in claim 9 wherein:

a) said first and second tube members comprise interior and exterior tube members telescopically engaged; and b) said reversible securing means comprises a "tent pole" offset cam fastened at the end of said interior tube member for frictional engagement with said exterior tube member upon twisting said tube members relative to each other.

12. An adjustable security bar assembly as in claim 9 wherein:

a) said tube members comprise interior and exterior tubes telescopically slidable with respect to each other; and b) said reversible securing means comprises a partially flattened end portion of said interior tube forming elliptical shaped cross section and an elliptically shaped said exterior tube such that twisting said tube members frictionally engages said elliptical tube portions securing them from telescopic sliding.

13. A security door bar assembly as in claim 1 wherein said means attached to said wall at either side of said door comprises:

a) said latching member having a first end with a first orifice formed therein aligned with said elongated direction of said latching member and a second end having a second orifice formed thereon perpendicular to the direction of said latching member;

b) a first "L" shaped hook bolt having a threaded leg fastened substantially perpendicular into a stud of said wall adjacent said door and having a smooth leg projecting at substantially a right angle from said threaded leg and horizontally parallel toward said door which smooth leg is sized for sliding engagement with said first orifice of said latching member; and c) a second hook bolt having a threaded shaft portion fastened to the wall adjacent said hinged door side and having a smooth hook portion projecting substantially at a right angle and vertically parallel to said wall, which smooth hook portion is sized for engagement with said second orifice formed on said hinged end of said latching member.

14. An adjustable security door bar assembly as in claim 1 further comprising a friction device held between said latching member and said cylindrical hole so that said polygon-shaped tension block is frictional held in a desired position on said latching member so that a desired amount of tension can be repeatedly reapplied each time said latching member is secured across said door.

15. An adjustable security door bar assembly as in claim 14 wherein said friction device comprises a metallic staple fastened into said cylindrical hole so that a portion of said staple projects into said hole for providing frictional tension between said latching member and the cylindrical hole in said polygon-shaped block.

16. An adjustable security door bar assembly as in claim 14 wherein said frictional tension device comprises:

a) a first passage drilled at a shallow angle with respect to the axis of said cylindrical hole and thereinto from one direction;

b) a second passage drilled at a shallow angle with respect to the axis of said cylindrical hole and thereinto from another direction such that a projection of said first and second passages would intersect each other inside of said cylindrical hole; and c) a length of piano wire having ends inserted through and held in said first and second passages such that a bowed portion extends into said hole for placing tension on said latching member on which said polygon shape is slidably and rotatably mounted through said cylindrical hole.

17. An adjustable security door bar assembly as in claim 1 wherein the flat faces of said polygon block are labeled so that the block can be conveniently positioned to a selected face-to-hole distance upon securing said latching member across said door so that a desired amount of tension can be repeatedly applied each time said latching member is secured across the door.

18. A security door bar for overlying a door or the like to prevent the opening thereof by intruders and comprising an elongated latching member comprising:

a) an elongated latching member including a pair of telescopically arranged elongate tubular elements with means for temporarily fastening said elements together at a fixed length;

b) a polygon shaped block made from rigid material with a cylindrical hole having a diameter which extends through the block, said hole being located such that its centerline is perpendicular to the parallel ends of said polygon block and such that the distances from the centerline of the hole to the different faces of the polygon are different in length;

c) one of said tubular elements having a diameter smaller than said diameter of the hole and received through the hole through the block;

d) the hole through the block having means therein to prevent said block from freely rotating or freely sliding on said relatively smaller tubular element;

e) an "L" shaped metal screw hook having a long and a short side, said long side having screw threads and being screwed into a wall stud adjacent to the knob side of said door, with said short side or hook of the "L" shaped metal screw hook pointing toward the door opening and being generally perpendicular to an edge of said door;

f) a sheet of rigid material of sufficient size to accommodate a side surface of said polygon block is attached to the door at the knob side, such that said polygon-shaped block may be slidably positioned to overlie said sheet and rotated on said elongated latching member to choose a face of said polygon block to overlie said sheet;

g) one end of the elongated latching member on which the polygon-shaped block having an aperture adapted to be placed over said short side of said "L" shaped hook; and h) another end of the elongated latching member having an eye bolt secured thereto adapted to be placed over another screw hook bolt fastened adjacent to the hinge side of the door, such that when the latching member is secured at said knob side and pressed against said door through said polygon block and securely placed over the hook at the hinge side of the door, sufficient force will be applied to the door to prevent intruders from being able to kick open the door.

* * * * *